US007990130B2

(12) United States Patent
Yoshikawa

(10) Patent No.: US 7,990,130 B2
(45) Date of Patent: Aug. 2, 2011

(54) BAND GAP REFERENCE VOLTAGE CIRCUIT

(75) Inventor: Kiyoshi Yoshikawa, Chiba (JP)

(73) Assignee: Seiko Instruments Inc., Chiba (JP)

( * ) Notice: Subject to any disclaimer, the term of this patent is extended or adjusted under 35 U.S.C. 154(b) by 169 days.

(21) Appl. No.: 12/562,471

(22) Filed: Sep. 18, 2009

(65) Prior Publication Data

US 2010/0072972 A1 Mar. 25, 2010

(30) Foreign Application Priority Data

Sep. 22, 2008 (JP) ..... 2008-242862

(51) Int. Cl.
*G05F 3/16* (2006.01)

(52) U.S. Cl. ..... 323/313; 323/315; 327/538; 327/539; 327/540

(58) Field of Classification Search ..... 323/311, 323/312, 313, 314, 315, 316; 327/538, 539, 327/540

See application file for complete search history.

(56) References Cited

U.S. PATENT DOCUMENTS

| | | | | |
|---|---|---|---|---|
| 6,937,001 | B2 | 8/2005 | Ueda | |
| 7,106,129 | B2 * | 9/2006 | Nakai | 327/541 |
| 7,161,340 | B2 * | 1/2007 | Chiu | 323/316 |
| 7,764,114 | B2 * | 7/2010 | Son | 327/541 |
| 2004/0239409 | A1 * | 12/2004 | Jang et al. | 327/536 |

* cited by examiner

*Primary Examiner* — Adolf Berhane
*Assistant Examiner* — Nguyen Tran
(74) *Attorney, Agent, or Firm* — Brinks Hofer Gilson & Lione

(57) ABSTRACT

Provided is a band gap reference voltage circuit having an improved power supply rejection ratio. Owing to a voltage supply circuit (51), a power supply voltage (V5) does not depend on variation of a power supply voltage (Vdd). A voltage (V3–V2) which is generated across a resistor (41) and has a positive temperature coefficient is determined based not on the power supply voltage (Vdd) but on the power supply voltage (V5), and hence the voltage (V3–V2) does not depend on the variation of the power supply voltage (Vdd). As a result, the power supply rejection ratio of the band gap reference voltage circuit is improved.

16 Claims, 5 Drawing Sheets

BAND GAP REFERENCE VOLTAGE CIRCUIT

RELATED APPLICATIONS

This application claims priority under 35 U.S.C. §119 to Japanese Patent Application No. JP2008-242862 filed on Sep. 22, 2008, the entire content of which is hereby incorporated by reference.

BACKGROUND OF THE INVENTION

1. Field of the Invention

The present invention relates to a band gap reference voltage circuit which generates a reference voltage.

2. Description of the Related Art

A conventional band gap reference voltage circuit is now described. FIG. 5 is a circuit diagram illustrating the conventional band gap reference voltage circuit.

As temperature increases, a base-emitter voltage Vbe1 of an NPN bipolar transistor 101 decreases with a negative temperature coefficient. In this occasion, because an NPN bipolar transistor 102 is larger in emitter area than the NPN bipolar transistor 101, a base-emitter voltage Vbe2 of the NPN bipolar transistor 102 decreases with a negative temperature coefficient to be lower than the base-emitter voltage Vbe1 of the NPN bipolar transistor 101.

Here, an amplifier 106 operates so that a node A and a node B have the same voltage, and hence a voltage (ΔVbe=Vbe1−Vbe2) determined by subtracting the base-emitter voltage Vbe2 from the base-emitter voltage Vbe1 is generated across a resistor 105. It is found from the expression above that the voltage ΔVbe has a positive temperature coefficient. Accordingly, a current I2 flowing through a resistor 104 and the resistor 105 also has a positive temperature coefficient, and a voltage generated across the resistor 104 also has a positive temperature coefficient. Variation of the voltages generated across the resistor 104 and the resistor 105 each of which has a positive temperature coefficient and variation of the base-emitter voltage Vbe2 having a negative temperature coefficient cancel each other. Therefore, a reference voltage Vref does not depend on temperature, irrespective of a temperature coefficient of a current I1 flowing through a resistor 103 (see, for example, JP 2003-258105 A).

However, if a power supply voltage Vdd varies, due to a gate-source or gate-drain parasitic capacitance of a transistor (not shown) which is provided at an input stage of the amplifier 106, a gate voltage of the transistor also varies. This causes variation of the voltages at the nodes A and B. As a result, the voltage ΔVbe inevitably depends on the variation of the power supply voltage Vdd, which deteriorates a power supply rejection ratio of the band gap reference voltage circuit.

SUMMARY OF THE INVENTION

The present invention has been made in view of the above-mentioned problem, and therefore it is an object of the present invention to provide a band gap reference voltage circuit having an improved power supply rejection ratio.

In the band gap reference voltage circuit according to the present invention, owing to the voltage supply circuit, the second power supply voltage does not depend on the variation of the first power supply voltage. Therefore, the voltage which is generated across the first resistor and has a positive temperature coefficient does not depend on the variation of the first power supply voltage. As a result, a power supply rejection ratio of the band gap reference voltage circuit is improved.

DETAILED DESCRIPTION OF THE PREFERRED EMBODIMENTS

Referring to the accompanying drawings, embodiments of the present invention are described below.

First Embodiment

Figure 1:
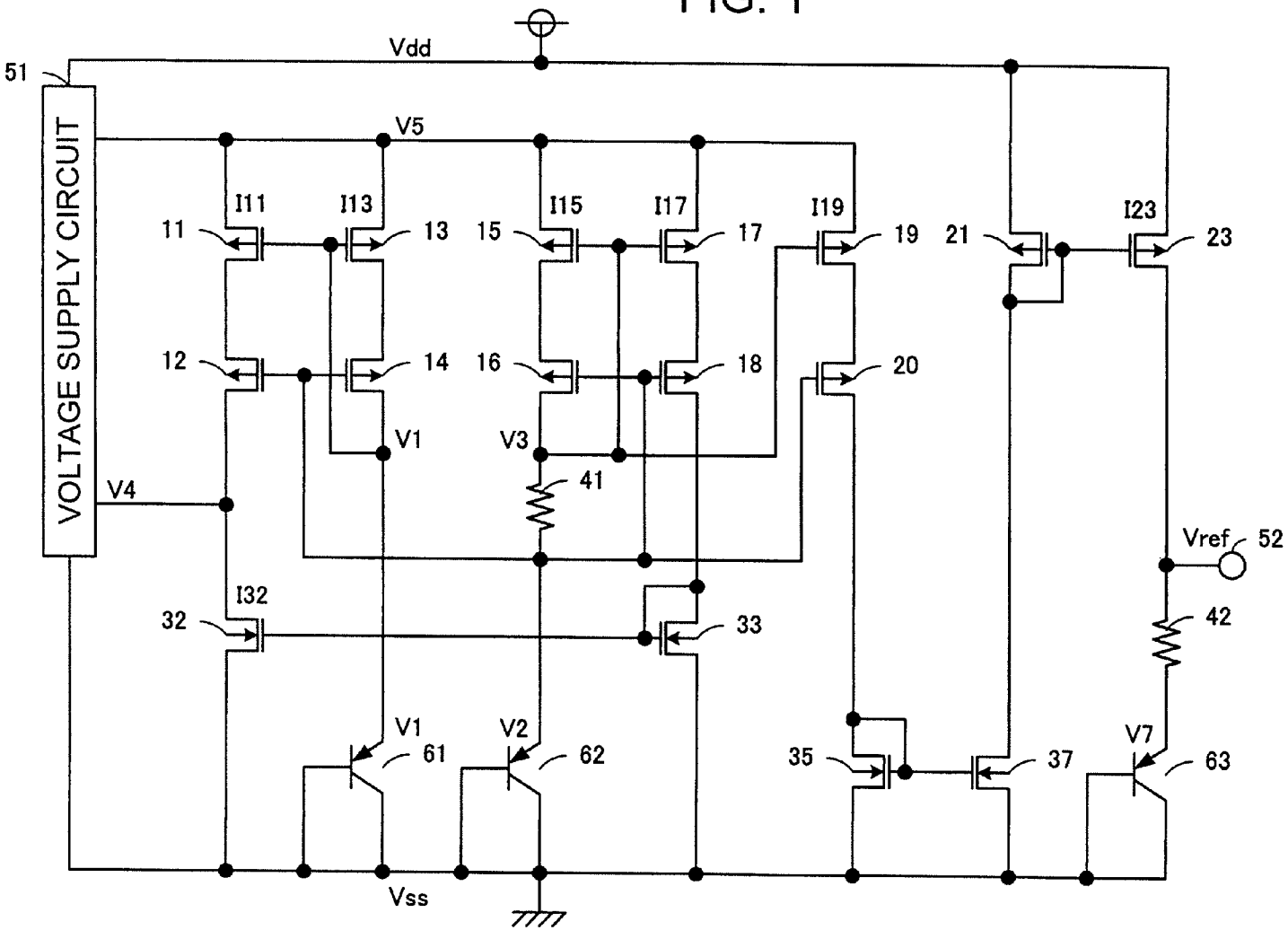
FIG. 1 is a circuit diagram illustrating a band gap reference voltage circuit according to a first embodiment of the present invention.

FIG. 1 is a circuit diagram illustrating a band gap reference voltage circuit according to a first embodiment of the present invention.

The band gap reference voltage circuit includes PMOS transistors 11 to 21, a PMOS transistor 23, NMOS transistors 32 and 33, an NMOS transistor 35, an NMOS transistor 37, resistors 41 and 42, a voltage supply circuit 51, and PNP bipolar transistors 61 to 63.

The voltage supply circuit 51 has a power supply terminal connected to a power supply terminal of the band gap reference voltage circuit, a ground terminal connected to a ground terminal of the band gap reference voltage circuit, and an input terminal connected to a connection point between a drain of the PMOS transistor 12 and a drain of the NMOS transistor 32. The PMOS transistor 11 has a source connected to an output terminal of the voltage supply circuit 51, and a drain connected to a source of the PMOS transistor 12. The NMOS transistor 32 has a source connected to the ground terminal, and the drain connected to the drain of the PMOS transistor 12. The PMOS transistor 13 has a gate connected to a gate of the PMOS transistor 11, a source connected to the output terminal of the voltage supply circuit 51, and a drain connected to a source of the PMOS transistor 14. The PMOS transistor 14 has a gate connected to a gate of the PMOS transistor 12, and a drain connected to an emitter of the PNP bipolar transistor 61 and to the gate of the PMOS transistor 11. The PNP bipolar transistor 61 has a base and a collector which are connected to the ground terminal.

The PMOS transistor 15 has a gate connected to a gate of the PMOS transistor 17, a source connected to the output terminal of the voltage supply circuit 51, and a drain connected to a source of the PMOS transistor 16. The PMOS transistor 16 has a gate connected to a gate of the PMOS transistor 18. The PMOS transistor 17 has a source connected to the output terminal of the voltage supply circuit 51, and a drain connected to a source of the PMOS transistor 18. The PMOS transistor 18 has a drain connected to a gate and a drain of the NMOS transistor 33 and to a gate of the NMOS transistor 32. The PMOS transistor 19 has a gate connected to the gate of the PMOS transistor 17 and to a connection point between a drain of the PMOS transistor 16 and the resistor 41. The PMOS transistor 19 has a source connected to the output terminal of the voltage supply circuit 51, and a drain connected to a source of the PMOS transistor 20. The PMOS transistor 20 has a gate connected to the gate of the PMOS transistor 18, to a connection point between the resistor 41 and an emitter of the PNP bipolar transistor 62, and to the gate of the PMOS transistor 12. The PMOS transistor 20 has a drain connected to a gate and a drain of the NMOS transistor 35 and to a gate of the NMOS transistor 37. The PNP bipolar transistor 62 has a base and a collector which are connected to the ground terminal. The NMOS transistor 33 has a source connected to the ground terminal. The NMOS transistor 35 has a source connected to the ground terminal.

The NMOS transistor 37 has a source connected to the ground terminal, and a drain connected to a gate and a drain of the PMOS transistor 21 and to a gate of the PMOS transistor 23. The PMOS transistor 21 has a source connected to the power supply terminal. The PMOS transistor 23 has a source connected to the power supply terminal, and a drain connected to an output terminal 52. The resistor 42 is provided between the output terminal 52 and an emitter of the PNP bipolar transistor 63. The PNP bipolar transistor 63 has a base and a collector which are connected to the ground terminal.

The PNP bipolar transistor 61 outputs a voltage V1 having a negative temperature coefficient in accordance with temperature. The PNP bipolar transistor 62 outputs a voltage V2 having a negative temperature coefficient in accordance with temperature. The resistor 41 generates, based on a voltage determined by subtracting the voltage V2 from the voltage V1, a voltage (V3−V2) having a positive temperature coefficient. The PMOS transistor 11 operates according to a power supply voltage V5, and causes an output current to flow therefrom based on the voltage V1. The PMOS transistor 17 operates according to the power supply voltage V5, and causes an output current to flow therefrom based on the voltage V3. The NMOS transistor 32 operates according to the power supply voltage V5, and causes an output current to flow therefrom based on the output current of the PMOS transistor 17. Therefore, a voltage V4 is determined based on the voltage V1 and the voltage V3. The voltage supply circuit 51 outputs the power supply voltage V5 based on the voltage V4. The power supply voltage V5 increases as the voltage V4 decreases, and decreases as the voltage V4 increases. In other words, the voltage supply circuit 51 controls the power supply voltage V5 so that the voltage V1 and the voltage V3 have the same value. The power supply voltage V5 does not depend on variation of a power supply voltage Vdd.

The PMOS transistor 23 operates according to the power supply voltage Vdd, and causes an output current having a positive temperature coefficient based on a current flowing through the resistor 41. The resistor 42 generates, based on the output current of the PMOS transistor 23, a voltage (Vref−V7) having a positive temperature coefficient. The PNP bipolar transistor 63 outputs the voltage V7 having a negative temperature coefficient based on the output current of the PMOS transistor 23 and in accordance with temperature.

Next, an operation of the band gap reference voltage circuit according to the first embodiment is described.

Here, the PMOS transistors 11 to 20 have the same size. The PMOS transistor 21 and the PMOS transistor 23 have the same size. The NMOS transistor 32 and the NMOS transistor 33 have the same size. The NMOS transistor 35 and the NMOS transistor 37 have the same size. An emitter area ratio of the PNP bipolar transistor 61 to the PNP bipolar transistor 62 is 1:N. An emitter area ratio of the PNP bipolar transistor 61 to the PNP bipolar transistor 63 is 1:M.

Further, an emitter voltage of the PNP bipolar transistor 61 corresponds to the voltage V1; an emitter voltage of the PNP bipolar transistor 62, the voltage V2; a drain voltage of the PMOS transistor 16, the voltage V3; an input voltage of the voltage supply circuit 51, the voltage V4; an output voltage of the voltage supply circuit 51, the power supply voltage V5; and an emitter voltage of the PNP bipolar transistor 63, the voltage V7. The PMOS transistor 11 causes a current I11 to flow therethrough; the PMOS transistor 13, a current I13; the PMOS transistor 15, a current I15; the PMOS transistor 17, a current I17; the PMOS transistor 19, a current I19; the PMOS transistor 23, a current I23; and the NMOS transistor 32, a current I32.

As temperature increases, the voltage V1 decreases to turn ON the PMOS transistor 11 so that the current I11 increases.

Further, the voltage V2 decreases to be lower than the voltage V1, and accordingly the voltage V3 also decreases to be lower than the voltage V1. Then, the PMOS transistor 17 is turned ON to increase the current I17. In this occasion, a value of the current I17 is larger than that of the current I11. The current I17 becomes equal to the current I32 because of a current mirror circuit formed of the NMOS transistor 32 and the NMOS transistor 33. Accordingly, the current I32 also increases.

A value of the current I32 is larger than the value of the current I11, and accordingly the voltage V4 decreases. The power supply voltage V5 increases because the voltage supply circuit 51 operates so that the power supply voltage V5 increases as the voltage V4 decreases, as described later. Then, a gate-source voltage of the PMOS transistor 15 increases to gradually turn ON the PMOS transistor 15, and accordingly the current I15 increases. Due to the increase of the current I15, the voltage (V3−V2) generated across the resistor 41 increases to gradually turn OFF the PMOS transistor 17, and accordingly the current I17 decreases. When the value of the current I17 decreases to be equal to that of the current I11, the value of the current I32 also becomes equal to that of the current I11. Therefore, the voltages V4 and V5 are stabilized without any variation. Then, the values of the current I11 and the current I17 become equal to each other, and accordingly the current I13 and the current I15 have the same value because of a current mirror circuit formed of the PMOS transistor 11 and the PMOS transistor 13 and a current mirror circuit formed of the PMOS transistor 15 and the PMOS transistor 17. As a result, the voltage V1 and the voltage V3 have the same value. In this way, the voltage supply circuit 51 varies the power supply voltage V5 so that the voltage V1 and the voltage V3 have the same value. Therefore, the voltage (V3−V2) which is accurately equal to a voltage (V1−V2) is generated across the resistor 41.

As described above, the voltage V1 and the voltage V3 have the same value, the voltages V1 and V2 each have a negative temperature coefficient, and the negative temperature coefficient of the voltage V2 has a steeper slope than that of the voltage V1. Therefore, the voltage (V3−V2) generated across the resistor 41 has a positive temperature coefficient, and accordingly the current I15 flowing through the resistor 41 also has a positive temperature coefficient. The current I15 becomes equal to the current I19 because of a current mirror circuit formed of the PMOS transistor 15 and the PMOS transistor 19. The current I19 becomes equal to the current I23 because of a current mirror circuit formed of the NMOS transistor 35 and the NMOS transistor 37 and a current mirror circuit formed of the PMOS transistor 21 and the PMOS transistor 23. The current I23 has a positive temperature coefficient, and thus the voltage (Vref−V7) generated across the resistor 42 also has a positive temperature coefficient. The voltage V7 has a negative temperature coefficient, and hence the positive temperature coefficient of the voltage (Vref−V7) and the negative temperature coefficient of the voltage V7 cancel each other at the output terminal 52, with the result that the reference voltage Vref is less likely to have temperature characteristics. Owing to the current mirror circuit formed of the NMOS transistor 35 and the NMOS transistor 37 and the current mirror circuit formed of the PMOS transistor 21 and the PMOS transistor 23, the reference voltage Vref is determined based not on the power supply voltage Vdd, which may vary to decrease, but on the power supply voltage V5.

Note that the PMOS transistor 12, the PMOS transistor 14, the PMOS transistor 16, the PMOS transistor 18, and the PMOS transistor 20 respectively serve as cascode circuits with the PMOS transistor 11, the PMOS transistor 13, the PMOS transistor 15, the PMOS transistor 17, and the PMOS transistor 19. Each of gate voltage differences between the latter transistor group and the former transistor group corresponds to the voltage (V3−V2) generated across the resistor 41. Accordingly, each of source voltage differences between the latter transistor group and the former transistor group also corresponds to the voltage (V3−V2) generated across the resistor 41. In other words, each of source-drain voltages of the latter transistor group corresponds to the voltage (V3−V2) generated across the resistor 41. Therefore, each of drain voltages of the latter transistor group is determined based not on a connection relation with respect to each of the drains of the latter transistor group, but on the voltage (V3−V2) generated across the resistor 41.

As described above, when temperature decreases, the voltage (V3−V2) which is accurately equal to the voltage (V1−V2) is generated across the resistor 41, and accordingly the reference voltage Vref is less likely to have temperature characteristics.

Next, numerical expressions which are established at respective nodes of the band gap reference voltage circuit according to the first embodiment are described.

When Boltzmann's constant is represented by k, absolute temperature is represented by T, and an absolute value of the elementary charge is represented by q, a coefficient A is calculated using Equation 1.

$$A=kT/q \tag{1}$$

When the current value which is the same among the current I11, the current I13, the current I15, the current I17, the current I19, and the current I23 is represented by I, and a reverse saturation current is represented by Is, the voltage V1 and the voltage V2 are respectively calculated using Expression (2) and Expression (3).

$$V1=A\ \ln(I/Is) \tag{2}$$

$$V2=A\ \ln\{I/(NIs)\} \tag{3}$$

Through Expressions (2) and (3), the voltage (V3−V2) generated across the resistor 41 is calculated using Expression (4).

$$V3-V2=V1-V2=A\ \ln(I/Is)-A\ \ln\{I/(NIs)\}=A\ \ln(N) \tag{4}$$

Through Expression (4), when a resistance of the resistor 41 is represented by R1, the current I is calculated using Expression (5).

$$I=(V3-V2)/R1=A\ \ln(N)/R1 \tag{5}$$

For each of the PMOS transistors 11 to 20, when a gate length is represented by Lp, a gate width is represented by Wp, carrier mobility is represented by μp, and a gate insulating film capacitance is represented by Coxp, drive performance Dp is calculated using Expression (6).

$$Dp=(Lp/Wp)\cdot 1/(\mu p\cdot Coxp) \tag{6}$$

For each of the PMOS transistor 11, the PMOS transistor 13, the PMOS transistor 15, and the PMOS transistor 17, a source-drain voltage Vdsp is calculated using Expression (7).

$$Vdsp=Dp^{1/2}\cdot(2I)^{1/2} \tag{7}$$

For the PMOS transistor 11, the PMOS transistor 13, the PMOS transistor 15, and the PMOS transistor 17, the source-drain voltage Vdsp of each of those transistors corresponds to the voltage generated across the resistor 41. Accordingly, through Expression (4), Expression (8) is established.

$$Vdsp=A\ \ln(N) \tag{8}$$

Through Expression (7) and Expression (8), Expression (9) is established.

$$Dp^{1/2}\cdot(2I)^{1/2}=A\ \ln(N) \tag{9}$$

Here, to secure respective operations of those transistors, Expression (10) needs to be always satisfied.

$$Dp^{1/2}\cdot(2I)^{1/2}<A\ \ln(N) \tag{10}$$

That is, through Expression (5), Expression (11) needs to be always satisfied.

$$Dp^{1/2}\cdot(2A\ \ln(N)/R1)^{1/2}<A\ \ln(N)$$

$$2Dp/R1<A\ \ln(N) \tag{11}$$

Both of the left side and the right side of Expression (11) have positive temperature coefficients, which means that Expression (11) is relatively easily satisfied.

For each of the PMOS transistor 11, the PMOS transistor 13, the PMOS transistor 15, and the PMOS transistor 17, when a threshold voltage is represented by Vtp, a gate-source voltage Vgsp is calculated using Expression (12).

$$Vgsp=Vtp+Vdsp \tag{12}$$

The voltage V5 is calculated using Expression (13).

$$V5=V1+Vgsp \tag{13}$$

The voltage V7 is calculated using Expression (14).

$$V7=A\ \ln\{I/(MIs)\} \tag{14}$$

Through Expression (5), when a resistance of the resistor 42 is represented by R2, the voltage (Vref−V7) is calculated using Expression (15).

$$Vref-V7=I\cdot R2=A\ \ln(N)R2/R1 \tag{15}$$

Through Expressions (5), (14), and (15), the voltage Vref is calculated using Expression (16).

$$\begin{aligned} Vref &= V7+(Vref-V7) \\ &= A\ln\{I/(MIs)\}+A\ln(N)\cdot R2/R1 \\ &= A\ln\{A\ln(N)/(R1\cdot MIs)\}+A\ln(N)\cdot R2/R1 \\ &= -A\ln\{(R1\cdot MIs)/A\ln(N)\}+A\ln(N)\cdot R2/R1 \end{aligned} \tag{16}$$

Here, in "{(R1·MIs)/A ln(N)}" in the first term of Expression (16), the coefficient A in the denominator and the reverse saturation current Is in the numerator vary with temperature. When the variable N in the denominator and the resistance R1 and the variable M in the numerator are adjusted so that temperature variation in the denominator becomes equal to temperature variation in the numerator, temperature variation in "{(R1·MIs)/A ln(N)}" described above is eliminated.

Figure 2:
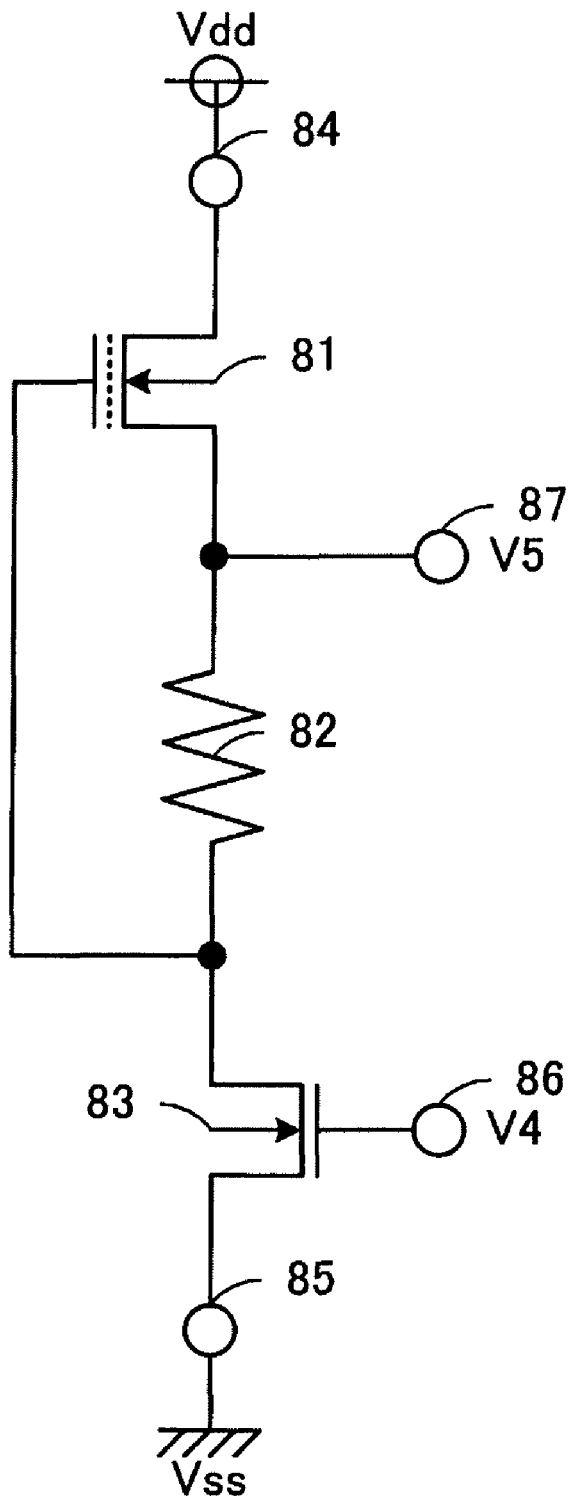
FIG. 2 is an example of a circuit diagram of a voltage supply circuit.

Next, the voltage supply circuit 51 is described. FIG. 2 is an example of a circuit diagram of the voltage supply circuit 51.

The voltage supply circuit 51 includes a depletion NMOS transistor 81, a resistor 82, and an NMOS transistor 83. The voltage supply circuit 51 further includes a power supply terminal 84, a ground terminal 85, an input terminal 86, and an output terminal 87.

The depletion NMOS transistor 81 has a gate connected to a connection point between the resistor 82 and a drain of the NMOS transistor 83. The depletion NMOS transistor 81 has a source connected to the output terminal 87, and a drain connected to the power supply terminal 84. The resistor 82 is provided between the output terminal 87 and the drain of the NMOS transistor 83. The NMOS transistor 83 has a gate connected to the input terminal 86, and a source connected to the ground terminal 85. The power supply voltage Vdd is input to the power supply terminal 84, and a ground voltage Vss is input to the ground terminal 85. The voltage V4 is input to the input terminal 86, and the power supply voltage V5 is output from the output terminal 87.

As the voltage V4 decreases, the NMOS transistor 83 is gradually turned OFF, and accordingly a gate voltage of the depletion NMOS transistor 81 increases. Then, the depletion NMOS transistor 81 is gradually turned ON, and accordingly the power supply voltage V5 increases. On the other hand, as the voltage V4 increases, the power supply voltage V5 decreases as described above. Note that when a current flows through the resistor 82, a voltage is generated across the resistor 82 and a gate-source voltage of the depletion NMOS transistor 81 decreases correspondingly. Then, the depletion NMOS transistor 81 is gradually turned OFF, and accordingly a current flowing through the depletion NMOS transistor 81 decreases. As a result, a consumption current of the voltage supply circuit 51 reduces. Further, because a voltage is generated across the resistor 82 when a current flows through the resistor 82, the gate-source voltage of the depletion NMOS transistor 81 becomes a negative voltage. However, a threshold voltage of the depletion NMOS transistor 81 is a negative voltage which is lower than the gate-source voltage thereof, and hence the depletion NMOS transistor 81 may be turned ON to cause a current to flow therethrough.

In this way, a current which flows through the resistor 82 and the NMOS transistor 83 is determined based on the voltages V4 and V5. Due to the flow of the current, the resistor 82 generates the gate-source voltage of the depletion NMOS transistor 81, and the power supply voltage V5 is determined based on the gate-source voltage and the voltage V4. Therefore, even if the power supply voltage Vdd varies, it is only a drain voltage of the depletion NMOS transistor 81 that varies, and the power supply voltage V5 does not vary. In other words, owing to the voltage supply circuit 51, the power supply voltage V5 does not depend on the variation of the power supply voltage Vdd. Accordingly, the voltage (V3−V2) which is generated across the resistor 41 and has a positive temperature coefficient is determined based not on the power supply voltage Vdd but on the power supply voltage V5, and hence the voltage generated across the resistor 41 does not depend on the variation of the power supply voltage Vdd. Therefore, a power supply rejection ratio of the band gap reference voltage circuit is improved.

Further, the voltage V1 and the voltage V3 are made equal to each other using not an amplifier but the voltage supply circuit 51 which has a simple circuit configuration, which makes it possible to reduce a circuit scale of the band gap reference voltage circuit correspondingly.

Besides, in the band gap reference voltage circuit, no amplifier is used to eliminate a constant current source for controlling the amplifier, and hence the power supply voltage V5 is not consumed by the constant current source. Therefore, the power supply voltage V5 may be set lower correspondingly, which makes it possible to set lower the power supply voltage V5 for minimum operation.

For example, it is supposed that in the band gap reference voltage circuit, an amplifier is used, a constant current source for controlling the amplifier is provided, and each of the PMOS transistors operates according to a constant current from the constant current source. In this case, as temperature decreases, threshold voltages of the respective PMOS transistors increase whereas overdrive voltages thereof do not change. As temperature increases, the threshold voltages thereof decrease whereas the overdrive voltages thereof do not change. This means that the overdrive voltages are kept constant. On the other hand, in the band gap reference voltage circuit according to the present invention, no amplifier is used to eliminate a constant current source for controlling the amplifier, and each of the PMOS transistors does not operate according to a constant current from the constant current source. Therefore, as temperature decreases, the threshold voltages of the respective PMOS transistors increase whereas the overdrive voltages thereof decrease. As temperature increases, the threshold voltages thereof decrease whereas the overdrive voltages thereof increase. This means that the overdrive voltages vary so that the variation of the threshold voltage and the variation of the overdrive voltage may cancel each other. As a result, as temperature decreases, the gate-source voltages of the respective PMOS transistors decrease. Therefore, the power supply voltage V5 may be set lower correspondingly, which makes it possible to set lower the power supply voltage V5 for minimum operation.

Further, all of gate-drain voltages (cascode circuit voltages) of the PMOS transistor 12, the PMOS transistor 14, the PMOS transistor 16, the PMOS transistor 18, and the PMOS transistor 20 correspond to the voltage (V3−V2) generated across the already-provided resistor 41. Therefore, it is not necessary to provide another circuit for generating each of the cascode circuit voltages, which makes it possible to reduce the circuit scale of the band gap reference voltage circuit correspondingly.

Further, even if temperature increases, the power supply voltage V5 increases to increase the gate-source voltages and source-drain voltages of the PMOS transistor 11, the PMOS transistor 13, the PMOS transistor 15, the PMOS transistor 17, and the PMOS transistor 19. Therefore, the drive performance of those transistors is not deteriorated.

Second Embodiment

Figure 3:
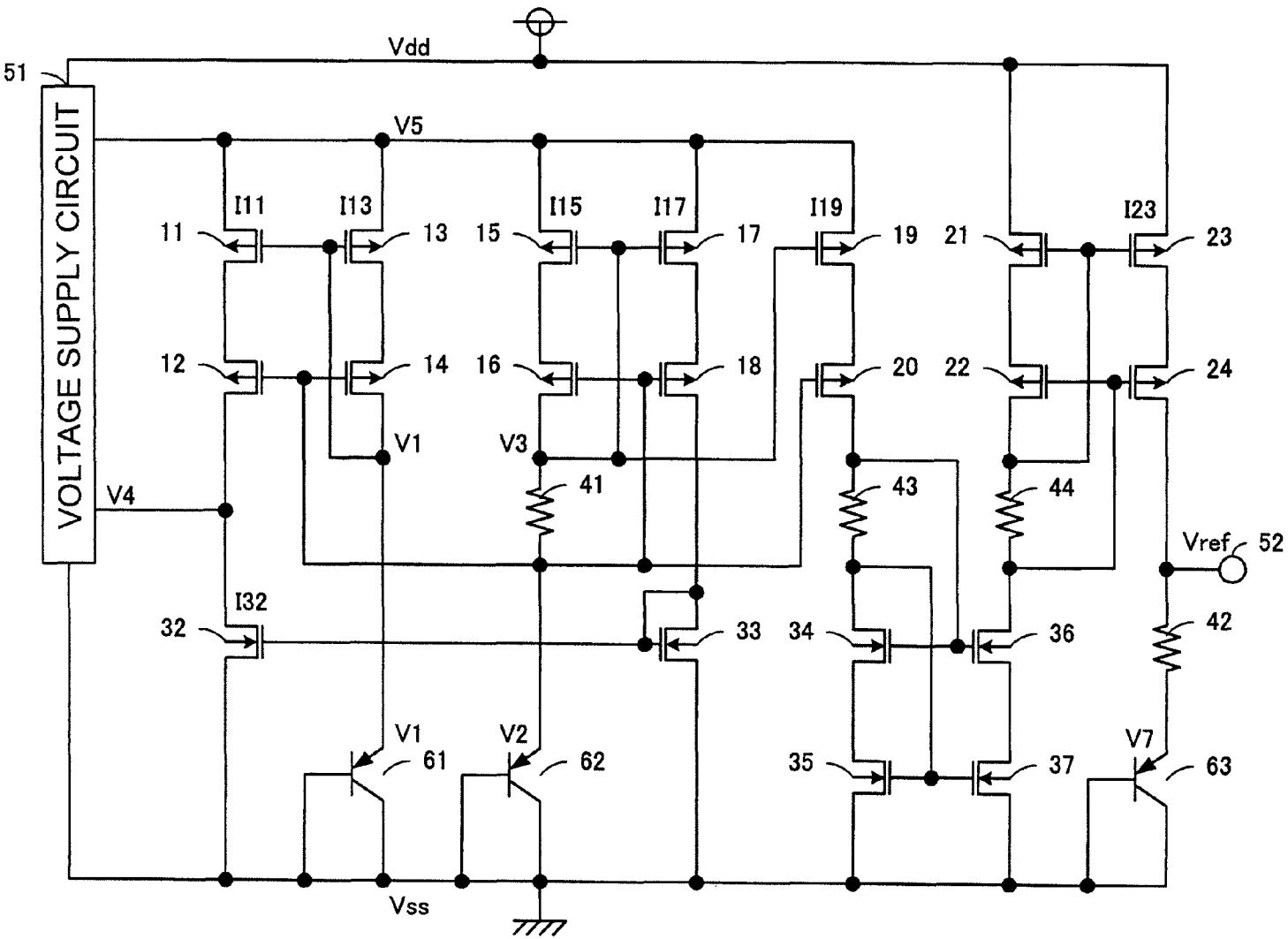
FIG. 3 is a circuit diagram illustrating a band gap reference voltage circuit according to a second embodiment of the present invention.

FIG. 3 is a circuit diagram illustrating a band gap reference voltage circuit according to a second embodiment of the present invention.

The band gap reference voltage circuit according to the second embodiment is different from the band gap reference voltage circuit according to the first embodiment in that a PMOS transistor 22, a PMOS transistor 24, resistors 43 and 44, an NMOS transistor 34, and an NMOS transistor 36 are added.

The PMOS transistor 19 has the gate connected to the gate of the PMOS transistor 17 and to the connection point between the drain of the PMOS transistor 16 and the resistor 41. The PMOS transistor 19 has the source connected to the output terminal of the voltage supply circuit 51, and the drain connected to the source of the PMOS transistor 20. The PMOS transistor 20 has the gate connected to the gate of the PMOS transistor 18, to the connection point between the resistor 41 and the emitter of the PNP bipolar transistor 62, and to the gate of the PMOS transistor 12. The PMOS transistor 20 has the drain connected to a gate of the NMOS transistor 34 and to a gate of the NMOS transistor 36. The resistor 43 is provided between the drain of the PMOS transistor 20 and a drain of the NMOS transistor 34. The NMOS transistor 34 has a source connected to the drain of the NMOS transistor 35. The NMOS transistor 35 has the gate connected to the gate of the NMOS transistor 37 and to the drain of the NMOS transistor 34. The NMOS transistor 35 has the source connected to the ground terminal. The PMOS transistor 21 has the gate connected to the gate of the PMOS transistor 23 and to a drain of the PMOS transistor 22. The PMOS transistor 21 has the source connected to the power supply terminal, and the drain connected to a source of the PMOS transistor 22. The PMOS transistor 22 has a gate connected to a gate of the PMOS transistor 24 and to a connection point between the resistor 44 and a drain of the NMOS transistor 36. The resistor 44 is provided between the drain of the PMOS transistor 22 and the drain of the NMOS transistor 36. The NMOS transistor 36 has a source connected to the drain of the NMOS transistor 37. The NMOS transistor 37 has the source connected to the ground terminal. The PMOS transistor 23 has the source connected to the power supply terminal, and the drain connected to a source of the PMOS transistor 24. The PMOS transistor 24 has a drain connected to the output terminal 52. The resistor 42 is provided between the output terminal 52 and the emitter of the PNP bipolar transistor 63. The PNP bipolar transistor 63 has the base and the collector connected to the ground terminal.

Next, an operation of the band gap reference voltage circuit according to the second embodiment is described.

Here, the PMOS transistors 21 to 24 have the same size. The NMOS transistors 34 to 37 have the same size.

When temperature increases, as in the first embodiment, the voltage (V3−V2) which is accurately equal to the voltage (V1−V2) is generated across the resistor 41, and accordingly the reference voltage Vref is less likely to have temperature characteristics.

Note that the NMOS transistor 34 and the NMOS transistor 36 respectively serve as cascode circuits with the NMOS transistor 35 and the NMOS transistor 37. Each of gate voltage differences between the latter transistor group and the former transistor group corresponds to a voltage generated across the resistor 43. Accordingly, each of source voltage differences between the latter transistor group and the former transistor group also corresponds to the voltage generated across the resistor 43. In other words, each of source-drain voltages of the latter transistor group corresponds to the voltage generated across the resistor 43. Therefore, each of drain voltages of the latter transistor group is determined based not on a connection relation with respect to each of the drains of the latter transistor group, but on the voltage generated across the resistor 43.

Besides, the PMOS transistor 22 and the PMOS transistor 24 respectively serve as cascode circuits with the PMOS transistor 21 and the PMOS transistor 23. Each of gate voltage differences between the latter transistor group and the former transistor group corresponds to a voltage generated across the resistor 44. Accordingly, each of source voltage differences between the latter transistor group and the former transistor group also corresponds to the voltage generated across the resistor 44. In other words, each of source-drain voltages of the latter transistor group corresponds to the voltage generated across the resistor 44. Therefore, each of drain voltages of the latter transistor group is determined based not on a connection relation with respect to each of the drains of the latter transistor group, but on the voltage generated across the resistor 44.

When temperature decreases, as in the first embodiment, the voltage (V3−V2) which is accurately equal to the voltage (V1−V2) is generated across the resistor 41, and accordingly the reference voltage Vref is less likely to have temperature characteristics.

Next, numerical expressions which are established at respective nodes of the band gap reference voltage circuit according to the second embodiment are described.

Through Expression (5), when a resistance of the resistor 43 is represented by R3, a voltage Vr3 generated across the resistor 43 is calculated using Expression (21).

$$Vr3=I\cdot R3=A\ \ln(N)\cdot R3/R1 \tag{21}$$

For each of the NMOS transistors 34 to 37, when a gate length is represented by Ln, a gate width is represented by Wn, carrier mobility is represented by μn, and a gate insulating film capacitance is represented by Coxn, drive performance Dn is calculated using Expression (22).

$$Dn=(Ln/Wn)\cdot 1/(\mu n\cdot Coxn) \tag{22}$$

For each of the NMOS transistor 35 and the NMOS transistor 37, a source-drain voltage Vdsn is calculated using Expression (23).

$$Vdsn=Dn^{1/2}\cdot(2I)^{1/2} \tag{23}$$

For the NMOS transistor 35 and the NMOS transistor 37, the source-drain voltage Vdsn of each of those transistors corresponds to the voltage Vr3 generated across the resistor 43. Accordingly, through Expression (21), Expression (24) is established.

$$Vdsn=A\ \ln(N)\cdot R3/R1 \tag{24}$$

Through Expression (23) and Expression (24), Expression (25) is established.

$$Dn^{1/2}\cdot(2I)^{1/2}=A\ \ln(N)\cdot R3/R1 \tag{25}$$

Here, to secure respective operations of those transistors, Expression (26) needs to be always satisfied.

$$Dn^{1/2}\cdot(2I)^{1/2}<A\ \ln(N)\cdot R3/R1 \tag{26}$$

That is, through Expression (5), Expression (27) needs to be always satisfied.

$$Dn^{1/2}(2A\ \ln(N)/R1)^{1/2}<A\ \ln(N)\cdot R3/R1$$

$$2Dn\cdot R1/R3^2<A\ \ln(N) \tag{27}$$

Both of the left side and the right side of Expression (27) have positive temperature coefficients, which means that Expression (27) is relatively easily satisfied.

Through Expression (5), when a resistance of the resistor 44 is represented by R4, a voltage Vr4 generated across the resistor 44 is calculated using Expression (28).

$$Vr4=I\cdot R4=A\ \ln(N)\cdot R4/R1 \tag{28}$$

For each of the PMOS transistors 11 to 24, when a gate length is represented by Lp, a gate width is represented by Wp, carrier mobility is represented by μp, and a gate insulating film capacitance is represented by Coxp, drive performance Dp is calculated using Expression (29).

$$Dp=(Lp/Wp)\cdot 1/(\mu p\cdot Coxp) \tag{29}$$

For each of the PMOS transistor 21 and the PMOS transistor 23, a source-drain voltage Vdsp is calculated using Expression (30).

$$Vdsp=Dp^{1/2}\cdot(2I)^{1/2} \quad (30)$$

For the PMOS transistor 21 and the PMOS transistor 23, the source-drain voltage Vdsp of each of those transistors corresponds to the voltage Vr4 generated across the resistor 44. Accordingly, through Expression (28), Expression (31) is established.

$$Vdsp=A\ \ln(N)\cdot R4/R1 \quad (31)$$

Through Expression (30) and Expression (31), Expression (32) is established.

$$Dp^{1/2}\cdot(2I)^{1/2}=A\ \ln(N)\cdot R4/R1 \quad (32)$$

Here, to secure respective operations of those transistors, Expression (33) needs to be always satisfied.

$$Dp^{1/2}\cdot(2I)^{1/2}<A\ \ln(N)\cdot R4/R1 \quad (33)$$

That is, through Expression (5), Expression (34) needs to be always satisfied.

$$Dp^{1/2}\cdot(2A\ \ln(N)/R1)^{1/2}<A\ \ln(N)\cdot R4/R1$$

$$2Dp\cdot R1/R4^2<A\ \ln(N) \quad (34)$$

Both of the left side and the right side of Expression (34) have positive temperature coefficients, which means that Expression (34) is relatively easily satisfied.

As described above, each of the drain voltages of the NMOS transistor 35 and the NMOS transistor 37 is determined based not on a connection relation with respect to each of the drains of the NMOS transistor 35 and the NMOS transistor 37, but on the voltage Vr3 generated across the resistor 43. Therefore, the output current of the current mirror circuit formed of the NMOS transistor 35 and the NMOS transistor 37 is determined accurately. Similarly, each of the drain voltages of the PMOS transistor 21 and the PMOS transistor 23 is determined based not on a connection relation with respect to each of the drains of the PMOS transistor 21 and the PMOS transistor 23, but on the voltage Vr4 generated across the resistor 44. Therefore, the output current of the current mirror circuit formed of the PMOS transistor 21 and the PMOS transistor 23 is determined accurately.

Third Embodiment

Figure 4:
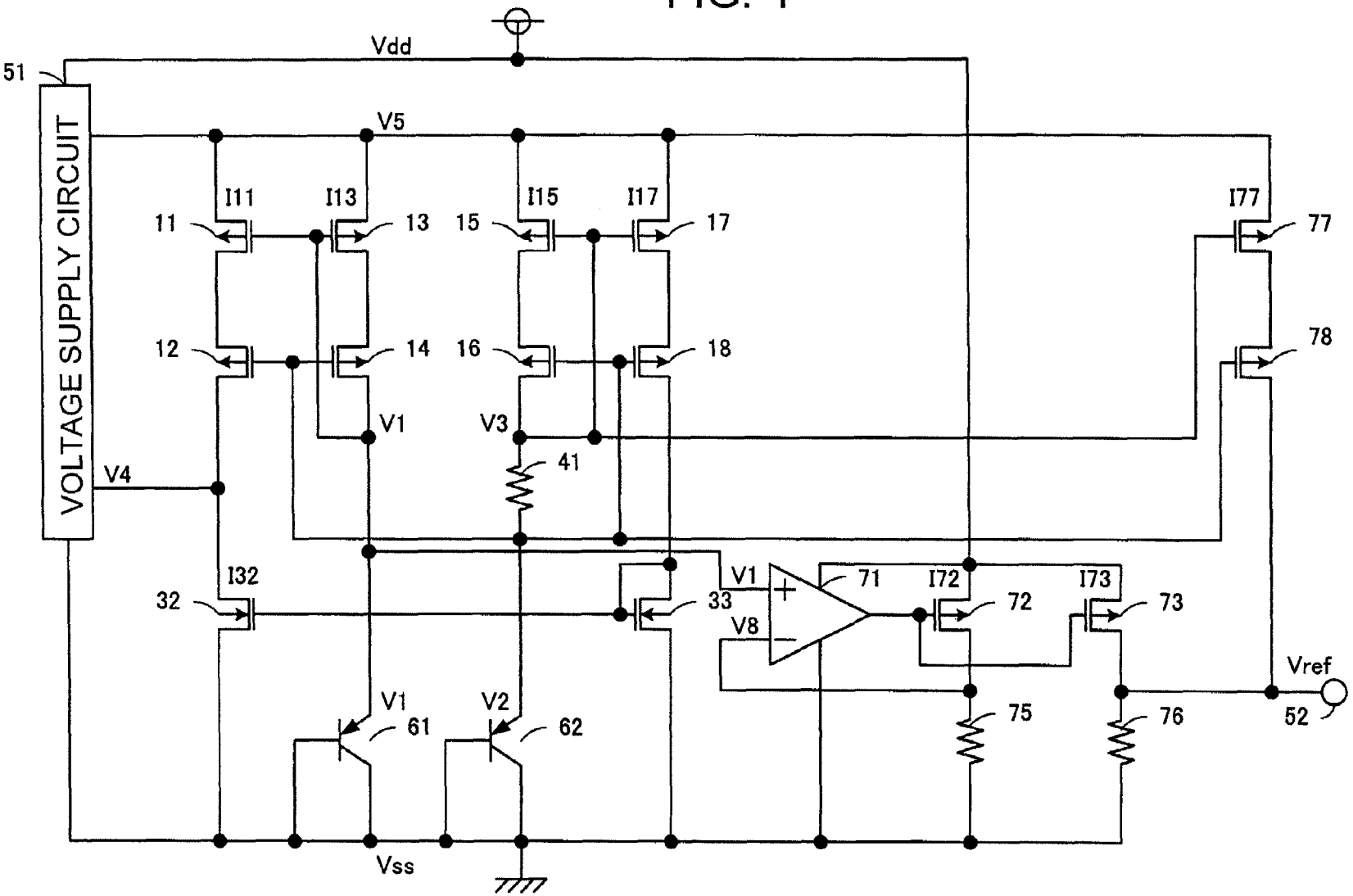
FIG. 4 is a circuit diagram illustrating a band gap reference voltage circuit according to a third embodiment of the present invention.
Figure 5:
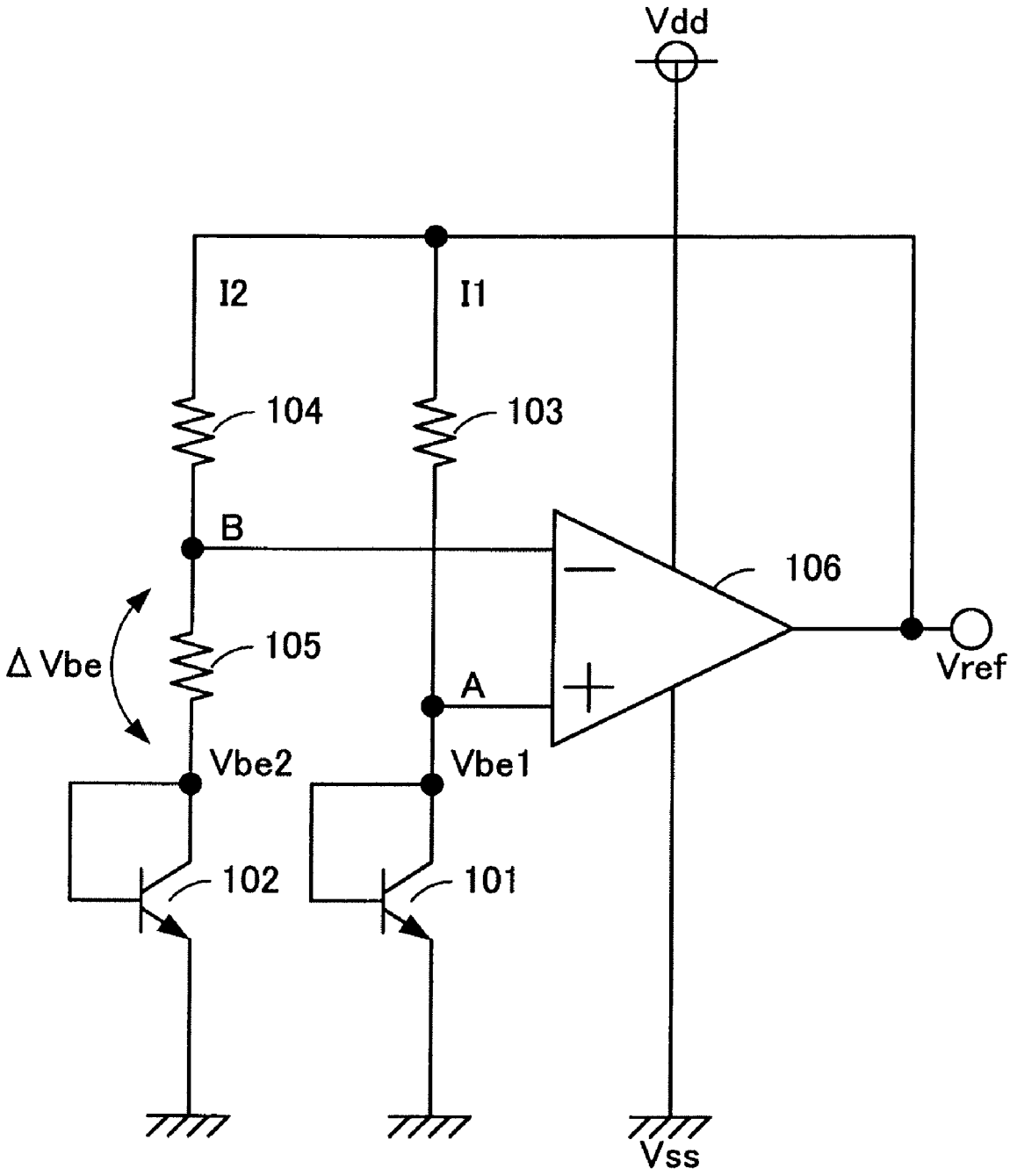
FIG. 5 PRIOR ART
FIG. 5 is a circuit diagram illustrating a conventional band gap reference voltage circuit.

FIG. 4 is a circuit diagram illustrating a band gap reference voltage circuit according to a third embodiment of the present invention.

The band gap reference voltage circuit according to the third embodiment is different from the band gap reference voltage circuit according to the first embodiment in that the PMOS transistors 19 to 21, the PMOS transistor 23, the NMOS transistor 35, the NMOS transistor 37, the resistor 42, and the PNP bipolar transistor 63 are eliminated, whereas an amplifier 71, PMOS transistors 72 and 73, resistors 75 and 76, and PMOS transistors 77 and 78 are added.

The amplifier 71 is provided between the power supply terminal and the ground terminal. The amplifier 71 has a non-inverting input terminal connected to a connection point between the drain of the PMOS transistor 14 and the emitter of the PNP bipolar transistor 61, an inverting terminal connected to a connection point between a drain of the PMOS transistor 72 and the resistor 75, and an output terminal connected to gates of the PMOS transistors 72 and 73. The PMOS transistor 72 has a source connected to the power supply terminal. The resistor 75 is provided between the drain of the PMOS transistor 72 and the ground terminal. The PMOS transistor 73 has a source connected to the power supply terminal, and a drain connected to the output terminal 52. The resistor 76 is provided between the output terminal 52 and the ground terminal. The PMOS transistor 77 has a gate connected to the gate of the PMOS transistor 17 and to the connection point between the drain of the PMOS transistor 16 and the resistor 41. The PMOS transistor 77 has a source connected to the output terminal of the voltage supply circuit 51, and a drain connected to a source of the PMOS transistor 78. The PMOS transistor 78 has a gate connected to the gate of the PMOS transistor 18, to the connection point between the resistor 41 and the emitter of the PNP bipolar transistor 62, and to the gate of the PMOS transistor 12. The PMOS transistor 78 has a drain connected to the output terminal 52.

The PMOS transistor 77 operates according to the power supply voltage Vdd, and causes an output current having a positive temperature coefficient to flow therefrom based on the current flowing through the resistor 41. The PMOS transistor 72 operates according to the power supply voltage Vdd, and causes an output current having a negative temperature coefficient to flow therefrom based on the voltage V1 and a voltage generated across the resistor 75. The PMOS transistor 73 operates according to the power supply voltage Vdd, and causes an output current having a negative temperature coefficient to flow therefrom based on the output current of the PMOS transistor 72. The resistor 76 causes both of the output current having a positive temperature coefficient of the PMOS transistor 77 and the output current having a negative temperature coefficient of the PMOS transistor 73 to flow therethrough, to thereby generate the reference voltage Vref.

Next, an operation of the band gap reference voltage circuit according to the third embodiment is described.

Here, all of the PMOS transistors 11 to 18 and the PMOS transistors 77 and 88 have the same size. The PMOS transistors 72 and 73 have the same size.

A voltage at the non-inverting input terminal of the amplifier 71 is the voltage V1, and a voltage at the inverting input terminal of the amplifier 71 is a voltage V8. The PMOS transistor 72 causes a current I72 to flow therethrough; the PMOS transistor 73, a current I73; and the PMOS transistor 77, a current I77.

When temperature increases, as in the first embodiment, the voltage (V3−V2) which is accurately equal to the voltage (V1−V2) is generated across the resistor 41.

As in the first embodiment, the voltage V1 and the voltage V3 have the same value, the voltages V1 and V2 each have a negative temperature coefficient, and the negative temperature coefficient of the voltage V2 has a steeper slope than that of the voltage V1. Therefore, the voltage (V3−V2) generated across the resistor 41 has a positive temperature coefficient, and accordingly the current I15 flowing through the resistor 41 also has a positive temperature coefficient. The current I15 becomes equal to the current I77 because of a current mirror circuit formed of the PMOS transistor 15 and the PMOS transistor 77. The current I77 also has a positive temperature coefficient.

The non-inverting input terminal and the inverting input terminal of the amplifier 71 are virtually short-circuited with each other, and hence the voltage V1 and the voltage V8 have substantially the same value. The voltage V1 and the voltage V8 each have a negative temperature coefficient, and hence the current I72 also has a negative temperature coefficient. The current I72 becomes equal to the current I73 because of a current mirror circuit formed of the PMOS transistor 72 and the PMOS transistor 73. The current I73 also has a negative temperature coefficient.

Here, the current I77 and the current I73 flow through the resistor 76. The current I77 has a positive temperature coefficient and the current I73 has a negative temperature coefficient. Therefore, the positive temperature coefficient of the current I77 and the negative temperature coefficient of the current I73 cancel each other at the output terminal 52, with the results that the current flowing through the resistor 76 is less likely to have temperature characteristics, and that the voltage generated across the resistor 76 is also less likely to have temperature characteristics. Accordingly, the reference voltage Vref is less likely to have temperature characteristics.

As described above, when temperature decreases, the voltage (V3−V2) which is accurately equal to the voltage (V1−V2) is generated across the resistor 41, and accordingly the reference voltage Vref is less likely to have temperature characteristics.

Next, numerical expressions which are established at respective nodes of the band gap reference voltage circuit according to the third embodiment are described.

Through Expression (2), when a current value which is the same between the current I72 and the current I73 is represented by I2, and a resistance of the resistor 75 is represented by R5, the voltage V8 and the current I2 are respectively calculated using Expression (51) and Expression (52).

$$V8=V1=A\ \ln(I/Is)=R5\cdot I2 \tag{51}$$

$$I2=A\ \ln(I/Is)/R5 \tag{52}$$

Through Expression (5) and Expression (52), a current I3 flowing through the resistor 75 is calculated using Expression (53).

$$I3=A\ \ln(N)/R1+A\ \ln(I/Is)/R5=A\ \ln(N)/R1+A\ \ln\{A\ \ln(N)/(R1\cdot Is)\}/R5 \tag{53}$$

When a resistance of the resistor 76 is represented by R6, the reference voltage Vref is calculated using Expression (54).

$$Vref=R6\cdot I3=A\ \ln(N)\cdot R6/R1+A\ \ln\{A\ \ln(N)/(R1\cdot Is)\}\cdot R6/R5=A\ \ln(N)\cdot R6/R1-A\ \ln\{R1\cdot Is/A\ \ln(N)\}\cdot R6/R5 \tag{54}$$

Here, in "{R1·Is/A ln(N)}" in the second term of Expression (54), the coefficient A in the denominator and the reverse saturation current Is in the numerator vary with temperature. When the variable N in the denominator and the resistance R1 in the numerator are adjusted so that temperature variation in the denominator becomes equal to temperature variation in the numerator, temperature variation in "{R1·Is/A ln(N)}" described above is eliminated.

In this way, a current mirror ratio between the current mirror circuit formed of the PMOS transistor 15 and the PMOS transistor 77 and the current mirror circuit formed of the PMOS transistor 72 and the PMOS transistor 73 is adjusted, to thereby control the current I77 and the current I73. Then, the current flowing through the resistor 76 is controlled, and accordingly the voltage generated across the resistor 76 is controlled. Consequently, the reference voltage Vref is controlled. For example, when the current I77 and the current I73 decrease, the current flowing through the resistor 76 also decreases. Then, the voltage generated across the resistor 76 decreases so that the reference voltage Vref decreases. In this way, it becomes possible to easily output a low reference voltage Vref.

What is claimed is:

1. A band gap reference voltage circuit for supplying a reference voltage constant with temperature, comprising:

a first power source configured to generate a first voltage;

a second power source powered by the first voltage to generate a second voltage independent of fluctuations of the first voltage from the first power source;

a first temperature sensor having a first temperature characteristic;

a second temperature sensor having a second temperature characteristic;

a first current mirror circuit powered by the second voltage to drive the first temperature sensor to generate a first sensor voltage across the first temperature sensor and caused by the first sensor voltage to flow a first sensor current through the first current mirror circuit;

a second current mirror circuit powered by the second voltage to drive the second temperature sensor via a resistor to generate a second sensor voltage across the second temperature sensor and caused by a sum of the second sensor voltage and a voltage appearing across the resistor to flow a second sensor current having a temperature dependency polarity through the second current mirror circuit;

a current coupler configured to use one of the first and second sensor currents as a reference current to generate the reference voltage having the same temperature dependency polarity as the reference current; and a polarity offset circuit configured to provide the reference voltage with the opposite temperature dependency polarity to make the voltage reference substantially independent of temperature, wherein the second power source is responsive to a difference between the first sensor current and the second sensor current to change the second voltage such that the first and second sensor currents become substantially equal, and wherein when the first and second sensor currents are substantially equal, the resistor produces thereacross a voltage substantially equal to a difference between the first and second sensor voltage and having a temperature dependency polarity determined by the first and second temperature characteristics of the first and second temperature sensors, which polarity determines the temperature dependency polarity of the reference current.

2. The band gap reference voltage circuit according to claim 1, further comprises a third current mirror circuit to couple the first sensor current and the second sensor current to create a current representative of a difference therebetween.

3. The band gap reference voltage circuit according to claim 1, wherein the first current mirror circuit comprises:

a first drive circuit powered by the second voltage to drive the first temperature sensor to generate the first sensor voltage; and a first current circuit connected with the first drive circuit and caused by the first sensor voltage to flow the first sensor current.

4. The band gap reference voltage circuit according to claim 3, wherein the first drive circuit comprises a drive transistor serially connected to the first temperature sensor, and the first current circuit comprises a current transistor coupled to form a current mirror circuit with the first drive transistor.

5. The band gap reference voltage circuit according to claim 4, wherein at least one of the first drive circuit and the first current circuit comprises a cascode-connected transistor.

6. The band gap reference voltage circuit according to claim 1, wherein the second current mirror circuit comprises:

a second drive circuit powered by the second voltage to drive the second temperature sensor via the resistor to generate the second sensor voltage; and a second current circuit connected to the second drive circuit and caused by the sum of the second sensor voltage and the voltage appearing across the resistor to flow the second sensor current.

7. The band gap reference voltage circuit according to claim 6, wherein the second drive circuit comprises a drive transistor serially connected to the second temperature sensor, and the second current circuit comprises a current transistor coupled to form a current mirror circuit with the second drive transistor.

8. The band gap reference voltage circuit according to claim 7, wherein at least one of the second drive circuit and the second current circuit comprises a cascode-connected transistor.

9. The band gap reference voltage circuit according to claim 1, wherein the second power source comprises a voltage adjusting transistor which turns toward an off-state and increases the second voltage, whereas turning toward an on-state and decreasing the second voltage, according to a change in the difference between the first and second sensor currents.

10. The band gap reference voltage circuit according to claim 6, wherein the current coupler comprises a fourth current mirror circuit formed with the second drive circuit of the second current mirror circuit and powered by the second voltage to copy the reference current.

11. The band gap reference voltage circuit according to claim 10, wherein the current coupler further comprises a fifth current mirror circuit to copy the reference current from the fourth current mirror circuit, and a sixth current mirror circuit powered by the first voltage to copy the copied reference current to generate the reference voltage.

12. The band gap reference voltage circuit according to claim 11, wherein at least one of the fifth and sixth current mirror circuits comprises at least one cascode-connected transistor.

13. The band gap reference voltage circuit according to claim 1, wherein the polarity offset circuit comprises a third temperature sensor functions with the opposite temperature dependency polarity.

14. The band gap reference voltage circuit according to claim 1, wherein the polarity offset circuit comprises an operational amplifier driven by one of the first and second sensor voltages to output an current having the opposite temperature dependency polarity, and wherein the polarity offset circuit further comprises a seventh current mirror circuit configured to copy the current outputted from the operational amplifier to offset the temperature dependency polarity of the reference current.

15. A method for supplying a reference voltage constant with temperature, comprising:

generating a first voltage;

powered by the first voltage, generating a second voltage independent of fluctuations of the first voltage;

powered by the second voltage, driving a first temperature sensor having a first temperature characteristic to generate a first sensor voltage across the first temperature sensor;

caused by the first sensor voltage, flowing a first sensor current;

powered by the second voltage, driving, via a resistor, a second temperature sensor having a second temperature characteristic to generate a second sensor voltage across the second temperature sensor;

caused by a sum of the second sensor voltage and a voltage appearing across the resistor, flowing a second sensor current having a temperature dependency polarity;

using one of the first and second sensor currents as a reference current, generating the reference voltage having the same temperature dependency polarity as the reference current;

providing the reference voltage with the opposite temperature dependency polarity to make the voltage reference substantially independent of temperature; and responsive to a difference between the first sensor current and the second sensor current, changing the second voltage such that the first and second sensor currents become substantially equal, wherein when the first and second sensor currents are substantially equal, the resistor produces thereacross a voltage substantially equal to a difference between the first and second sensor voltage and having a temperature dependency polarity determined by the first and second temperature characteristics of the first and second temperature sensors, which polarity determines the temperature dependency polarity of the reference current.

16. A band gap reference voltage circuit for supplying a reference voltage constant with temperature, comprising:

means for generating a first voltage;

means powered by the first voltage to generate a second voltage independent of fluctuations of the first voltage;

means powered by the second voltage to drive a first temperature sensor having a first temperature characteristic to generate a first sensor voltage across the first temperature sensor;

means caused by the first sensor voltage to flow a first sensor current;

means powered by the second voltage to drive, via a resistor, a second temperature sensor having a second temperature characteristic to generate a second sensor voltage across the second temperature sensor;

means caused by a sum of the second sensor voltage and a voltage appearing across the resistor to flow a second sensor current having a temperature dependency polarity;

means using one of the first and second sensor currents as a reference current to generate the reference voltage having the same temperature dependency polarity as the reference current; and means for providing the reference voltage with the opposite temperature dependency polarity to make the voltage reference substantially independent of temperature, wherein said means for generating the second voltage is responsive to a difference between the first sensor current and the second sensor current to change the second voltage such that the first and second sensor currents become substantially equal, and wherein when the first and second sensor currents are substantially equal, the resistor produces thereacross a voltage substantially equal to a difference between the first and second sensor voltage and having a temperature dependency polarity determined by the first and second temperature characteristics of the first and second temperature sensors, which polarity determines the temperature dependency polarity of the reference current.

* * * * *